United States Patent [19]

Bousgarbiès

[11] 4,429,809

[45] Feb. 7, 1984

[54] DEVICE FOR THE METERED RELEASE OF AN ACTIVE INGREDIENT

[75] Inventor: Jacques Bousgarbiès, Poitiers, France

[73] Assignee: Airwick Industries, Inc., Carlstadt, N.J.

[21] Appl. No.: 253,972

[22] Filed: Apr. 13, 1981

[30] Foreign Application Priority Data

Apr. 25, 1980 [CH] Switzerland ..... 3208/80

[51] Int. Cl.[3] ..... E03D 9/02

[52] U.S. Cl. ..... 222/67; 4/227

[58] Field of Search ..... 222/64, 67, 204; 4/226, 4/227, 228; 222/416, 319, 68

[56] References Cited

U.S. PATENT DOCUMENTS

| | | | |
|---|---|---|---|
| 1,107,393 | 8/1914 | Williams . | |
| 2,839,763 | 6/1958 | Newsom | 4/227 |
| 2,912,200 | 11/1959 | Reinhorn | 248/103 |
| 2,913,734 | 11/1959 | O'Hare | 4/227 |
| 2,967,310 | 1/1961 | O'Hare | 4/227 |
| 2,991,911 | 7/1961 | Spain | 222/416 X |
| 3,023,426 | 3/1962 | Neal | 4/228 |
| 3,031,111 | 4/1962 | Stull | 222/541 |
| 3,118,645 | 1/1964 | Lewis et al. | 248/312 |
| 3,341,074 | 9/1967 | Pannutti | 222/57 |
| 3,698,021 | 10/1972 | Mack et al. | 4/227 |
| 3,766,570 | 10/1973 | Finneran | 4/222 |
| 3,774,808 | 11/1973 | La Vange | 222/57 |
| 3,778,850 | 12/1973 | Bryan | 4/227 |
| 3,841,524 | 10/1974 | Easter | 222/57 |
| 3,908,209 | 9/1975 | Fillmore | 4/227 |
| 3,945,062 | 3/1976 | Corsette | 4/227 |
| 4,036,407 | 7/1977 | Sloane | 4/227 |
| 4,131,958 | 1/1979 | Dolan | 4/227 |
| 4,189,793 | 2/1980 | Williamson et al. | 4/228 |

FOREIGN PATENT DOCUMENTS 2424374 11/1979 France .

*Primary Examiner*—Stanley H. Tollberg
*Attorney, Agent, or Firm*—Harry Falber

[57] ABSTRACT

A device for the metered release of an active ingredient from a stock container into a surrounding liquid, said device comprising a float-containing metering unit which releases a defined quantity of active ingredient when the float is raised and a release control unit which has a collecting chamber and an overflow syphon positioned in the chamber for transferring the defined quantity of active ingredient into the surrounding liquid.

17 Claims, 4 Drawing Figures

DEVICE FOR THE METERED RELEASE OF AN ACTIVE INGREDIENT

The invention relates to a device for the metered release of an active ingredient from a stock container into a surrounding liquid, the level of which rises and falls from time to time, in accordance with the pre-characterising clause of patent claim 1.

Devices of this type are used, for example, in toilet cisterns, in order to add any disinfectants, cleansers or deodorisers to the flushing water in the cistern.

During the process of flushing, only a relatively small remnant—roughly about one liter—of the total contents of the cistern remains in the syphon of the lavatory pan. For this reason, it would therefore be desirable to introduce a constant metered amount of active ingredient only into this last remnant of water in such a way that virtually all the active ingredient is concentrated in the syphon and nothing is lost with the flushing water which flows out.

The metering devices hitherto known for such purposes, as described, for example, in U.S. Pat. Nos. 2,967,310, 4,131,958 and 4,189,793, do not meet these requirements since they release the active ingredient into the whole of the flushing water present in the cistern. This leads to a considerable waste of active ingredient, since most of the flushing water, together with the active ingredient dissolved therein, flows out and is thus lost for the desired action in the syphon of the lavatory pan. To compensate this loss of active ingredient and hence of activity, it is necessary to meter the active ingredient in a higher concentration, and this in turn leads to an increased consumption of active ingredient and, last but not least, also to increased pollution of the environment.

The invention seeks to obviate these disadvantages. In particular, a metering device of the type defined in the pre-characterising clause of patent claim 1 is to be improved by the invention in such a way that it meets the requirements mentioned at the outset. A further object of the invention is to achieve this constructionally in the simplest and most inexpensive manner possible.

The device according to the invention comprises the characteristics of patent claim 1. Advantageous embodiments of the device according to the invention are described in the dependent claims.

According to a particularly simple and suitable embodiment, the release-control unit consists of a beaker-type collecting chamber which surrounds the metering unit and has, located in its bottom, an overflow pipe which in turn forms a syphon, together with a beaker which is located in the chamber, is open at the bottom and surrounds the pipe. As will be seen from the description of the operation which follows, the effect of this collecting chamber together with the syphon is that the active ingredient is released only into the flushing water left behind during the emptying of the cistern. Although a similar syphon is already known in the device for metering active ingredient into lavatory pans, described in the published French Patent Application No. 2,424,374, it serves a completely different purpose in that case. In contrast with the invention, this known metering device is not intended to be located in the cistern, but to be fitted directly in the lavatory pan. It contains an active ingredient in solid form, which is dissolved during the flushing process in the flushing water flowing over it. The syphon merely serves to collect the highly concentrated liquid residue dripping off from the moist active ingredient. In addition to the known disadvantages of all the metering devices which operate with solid active ingredients, this metering device also releases the active ingredient into the whole of the flushing water.

In the following text, the invention is explained in more detail by reference to the drawing. The four figures in the drawing each show an axial section through an illustrative embodiment of a device according to the invention, in the use position in four different operational phases.

Figure 1:
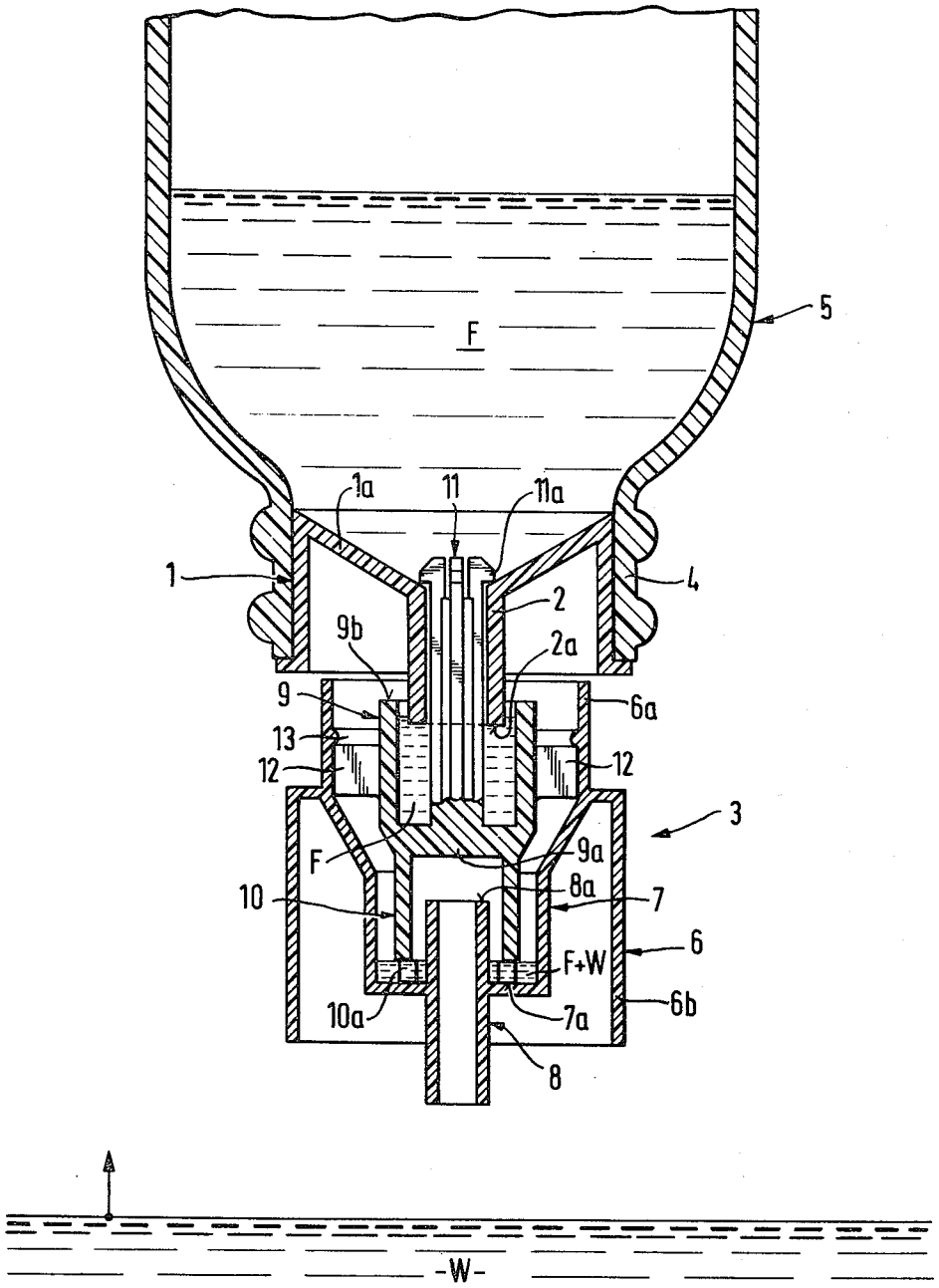
FIG. 1 shows the at rest position of the metering device.

The device of rotationally symmetrical shape comprises a carrier 1 with a coaxial pipe nozzle 2 and a float 3 which is guided on the carrier so that it can move up and down between an upper and a lower end position (in the use position).

The carrier 1 is designed as a hollow closing plug and it is tightly seated in the opening neck 4 of a stock container 5, for example a bottle of suitable shape, the neck being normally closed by a screw cap or the like. The bottom 1*a* of the carrier 1 is formed in the shape of a funnel and the pipe nozzle 2 ends axially at the lowest point of the bottom of the carrier.

The float is assembled from two coaxial parts which are themselves integral. The outer part consists of a float tube 6, an approximately tulip-shaped insert 7 which is open at the top and the edge of which is fixed around the float tube approximately in the upper third thereof and which divides the float tube into an upper and a lower tube section 6*a* and 6*b* respectively, and of an overflow pipe 8 which is fitted in the bottom 7*a* of the insert. The upper tube section 6*a* has a slightly smaller diameter than the lower section, but this is of no importance in operation. Downwards, the overflow pipe 8 opens into the surround, and its upper edge 8*a* is approximately half-way up the insert 7.

The inner part of the float consists of two cylindrical beakers 9 and 10 which are open at the top and at the bottom respectively and are joined by a common bottom 9*a*, of a coaxial guide rod 11 and four retaining vanes 12. The latter extend radially from the upper container 9 up to the inner wall of the upper tube section 6*a*. On the one hand, they rest on the upper rim of the insert 7 and, on the other hand, they are locked in place behind a ring bead 13 which is moulded onto the tube section 6*a* and projects inwards. By means of these retaining vanes 12, the two parts of the float 3 are immovably joined to one another.

The edge of the opening of the downwardly open beaker 10 of the inner float part rests on the bottom 7*a* of the insert 7. The edge of the opening is provided on its periphery with numerous perforations 10*a* so that the spaces within and outside the beaker 10 communicate. The diameter of the beaker 10 is about halfway between those of the overflow pipe 8 and of the lower zone of the insert 7.

The guide rod 11 has a cruciform profile. It is rigidly joined to the bottom 9*a* of the inner float part and is guided so that it is movable up and down in the pipe nozzle 2. Due to the cruciform profile, flow channels are left free in the pipe nozzle, and through these the liquid active ingredient F can flow from the stock container 5 into the beaker 9. The upper end of the guide rod 11 is slotted and is provided with four stop lugs 11*a* which can move resiliently radially inwards and which reach around the end or the upper edge of the opening of the pipe nozzle 2 and thus fix the guide rod 11 and hence the entire float 3 to the carrier 1. (To assemble the carrier 1 and the float 3, the guide rod 11 is simply introduced through the pipe nozzle 2, the stop lugs 11*a* being temporarily deformed inwards).

The diameter of the upper beaker 9 of the inner float part is slightly larger than that of the pipe nozzle 2. The height of the beaker 9 and the length of the pipe nozzle 2 are matched in such a way that the edge 2*a* of the lower opening of the nozzle 2, when the float 3 is in the lower end position shown in FIGS. 1 and 4, is just below the edge 9*b* of the opening of the beaker 9, or at approximately the same height. In the upper end position of the float 3, shown in FIGS. 2 and 3, however, the pipe nozzle 2 dips into the beaker 9 and rests on the bottom 9*a* thereof.

The device described operates as follows:

Initially, the device is inserted into the neck 4 of the container 5 which contains the liquid active ingredient F, and the container is then hung, with its neck pointing downwards, in a toilet cistern which is not shown here.

In the first operational phase, shown in FIG. 1, it is assumed that the toilet cistern has just been emptied and the level of the flushing water W, which may still be present therein or has already newly run in, is still low. In this phase, the float 3 is in its lower end position, due to its own weight. The metering chamber formed by the beaker 9 is filled with the active ingredient F up to the level of the lower edge of the pipe nozzle 2. Because of the hydrostatic pressure equilibrium, overflowing is not possible. A small remnant of liquid from the preceding flushing process is still present in the insert 7.

Figure 2:
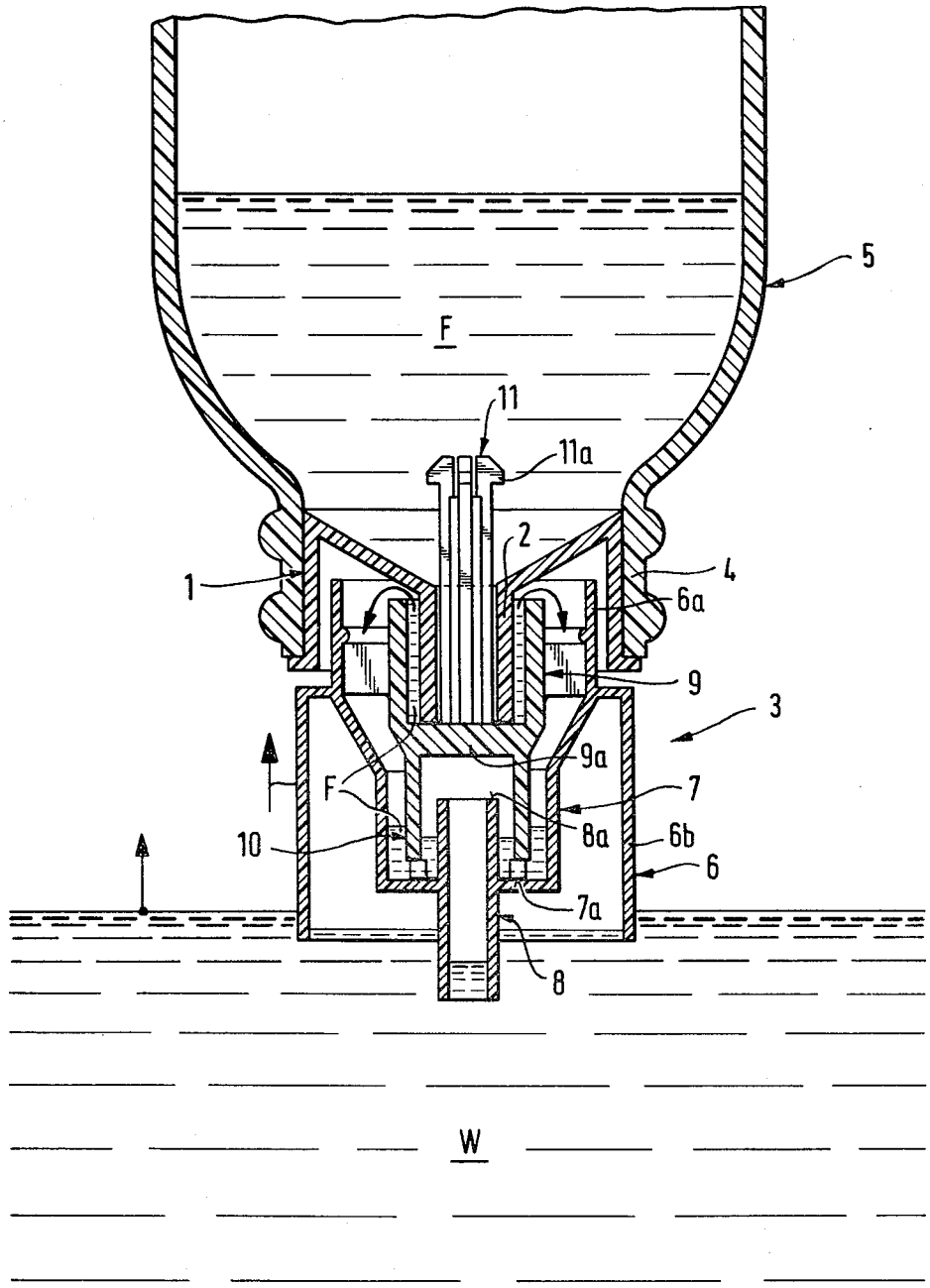
FIG. 2 shows the float raised to begin filling of the collecting chamber.

When the liquid level in the cistern then rises in the second operational phase, the float 3 is gradually lifted until it finally reaches its upper end position (FIG. 2). During the lifting of the float, the pipe nozzle 2 penetrates further and further into the metering chamber 9 and displaces a volume of active ingredient, corresponding to the state of immersion of the nozzle, from the metering chamber. This accurately metered volume then flows out over the edge of the chamber and collects in the lower part of the insert 7 which serves as the collecting chamber. The volume of active ingredient and/or the height of the overflow pipe 8 are such that the active ingredient does not flow off via the overflow 8.

Figure 3:
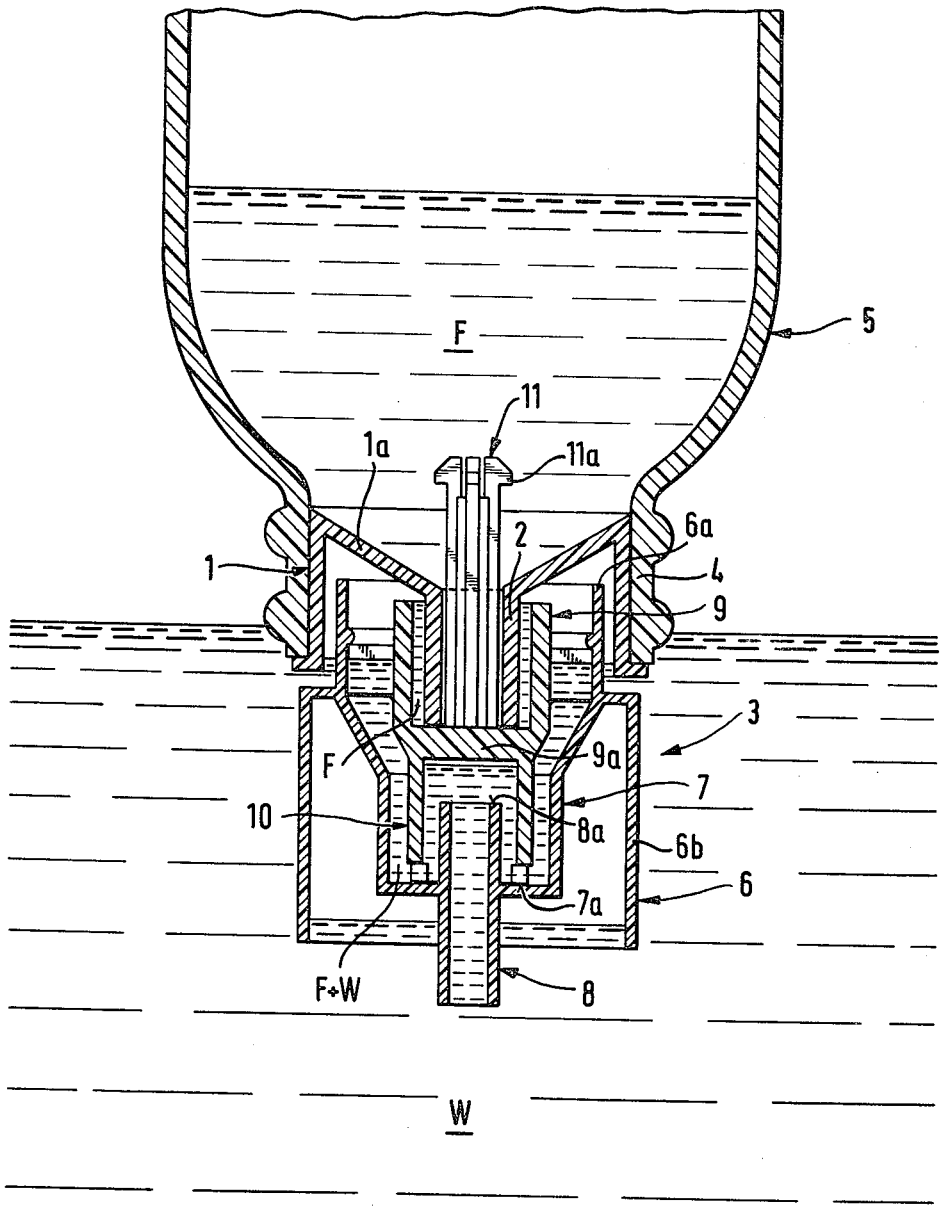
FIG. 3 shows water entering through the bottom of the overflow.
Figure 4:
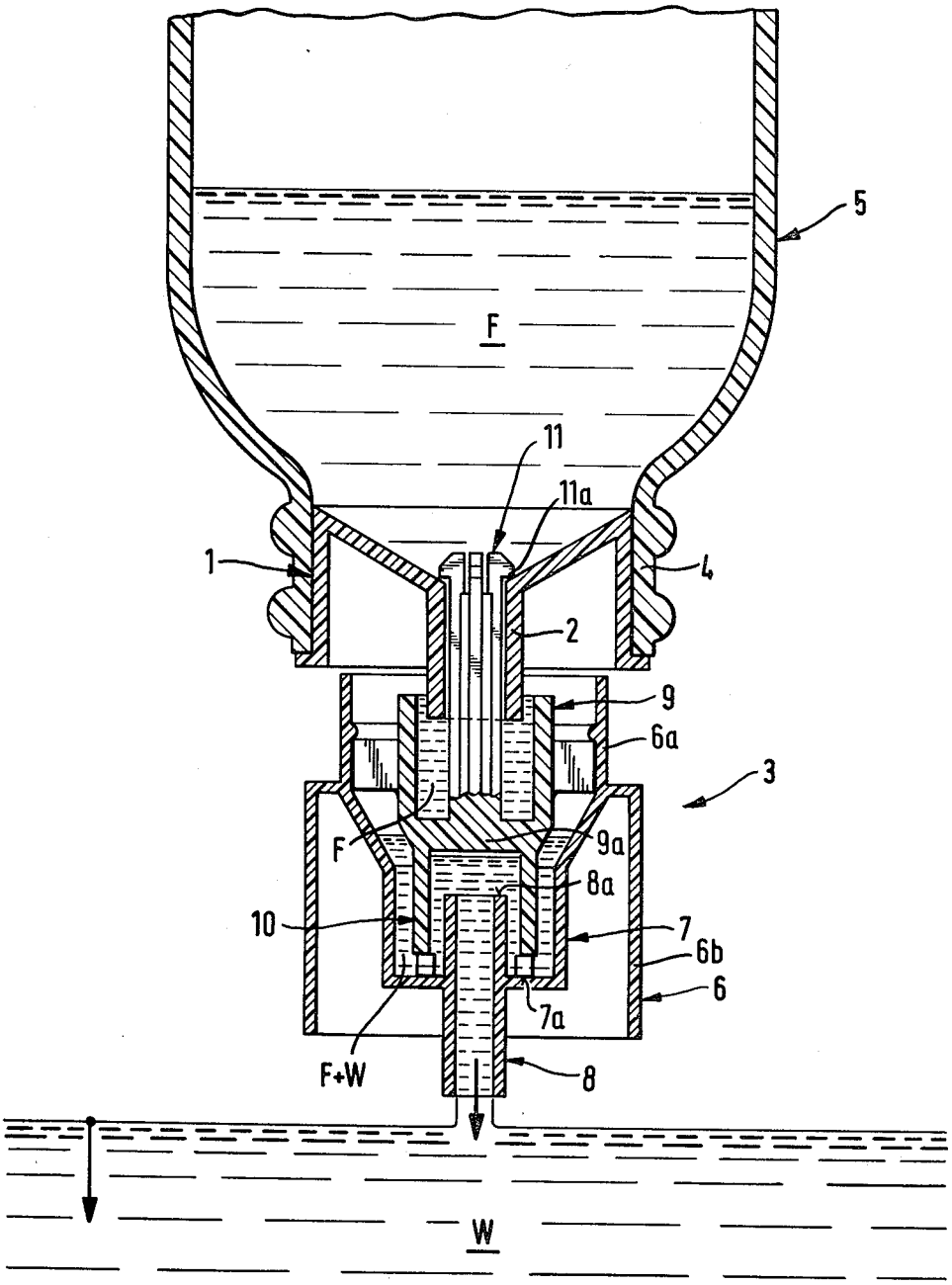
FIG. 4 shows syphon discharge.

When the water in the cistern rises further up to its highest level in the third operational phase, it enters the collecting chamber 7 through the overflow 8, effecting a pre-dilution of the liquid active ingredient present therein (FIG. 3). At this stage, as can be seen from the drawing, the pre-diluted active ingredient remains enclosed in the collecting chamber 7 and—apart from the negligible diffusion through the overflow 8—cannot pass into the surrounding flushing water. If, by any chance, the container 5 should be located in the cistern at a height lower than that shown, so that the highest water level is higher than that shown, relative to the neck 4 of the container, the water level within the space enclosed by the hollow carrier 1 cannot rise significantly higher because of the volume of air which is then enclosed, so that the active ingredient, present in the metering chamber 9, even then cannot come into contact with the water running in and cannot flow out of the metering chamber.

The last phase of the operational cycle of the device takes place during emptying of the cistern. As long as the water level in the cistern is approximately above the edge of the opening of the neck 4 of the container, substantially no action takes place. However, as soon as the water level falls still further, the pre-diluted active ingredient starts to flow out of the collecting chamber 7 via the overflow 8, the float 3 also moving downwards as the water level falls further, until it finally reaches the lowest end position shown in FIG. 4 (and FIG. 1). Due to the effect of the syphon formed between the walls of the overflow pipe 8 and the lower beaker 10, the collecting chamber 7 is thus emptied virtually completely but for a small remnant (FIG. 1). Together with the lowering of the float 3, the metering chamber 9 is also lowered, and new active ingredient F flows from the container 5, replenishing the metering chamber 9, whereby the initial state according to FIG. 1 is reached again.

Thus only in the last operational phase does the pre-diluted active ingredient pass into the water present in the cistern, and in particular only into the uppermost layer thereof, approximately corresponding to the last liter flowing out. This has the effect that essentially only the flushing water remaining in the syphon of the lavatory pan contains active ingredient, whilst the rest of the water, which flows out anyway, remains free from active ingredient. This in turn permits higher concentrations and nevertheless a lower consumption of active ingredient for a given number of flushes, and correspondingly, a greater effectiveness and greater economy. Thus, for example, with the same quantity of active ingredient and the same concentration of active ingredient in the syphon, more than twice as many flushes can be carried out than with the device described in U.S. Pat. No. 2,967,310.

Corresponding to this principle according to the invention, of both quantitatively metering and controlling the release of the active ingredient in time, the device according to the invention consists of two main components, specifically a quantitative metering unit and a release-control unit. The quantitative metering unit essentially consists of the metering chamber 9 and the pipe nozzle 2 as well as the float which actuates or controls them, and as a whole is designated 3. The release-control unit contains those elements which prevent a premature and hence undesired outflow of the quantity of active ingredient, released by the metering unit, into the surrounding liquid. The elements are in particular the collecting chamber 7 with the overflow pipe 8 and the lower beaker 10 which, together with the overflow pipe 8, forms the syphon. These elements also include the upper section 6*a* of the float tube 6 which, in the upper position of the float, projects into the carrier 1 and thus prevents the inflow into the water from above.

It is to be understood that the two main components of the invention, and in particular the release-control unit, can be designed in diverse ways. The only essential point is that the active ingredient is released solely during the emptying of the surrounding water, and specifically into the uppermost layer of the water, which flows out last. The embodiment of the device according to the invention, as described, is particularly advantageous since it is constructionally very simple and accordingly can be readily and inexpensively manufactured. Because of these properties, it is therefore also suitable as a mass-produced throw-away article, for example in conjunction with hygiene kits and the like.

What is claimed is:

1. A device for the metered release of a liquid active ingredient from a stock container into a surrounding liquid, the level of which rises and falls from time to time, having a level-controlled metering unit (2, 9, 3) with a movable float (3) guided thereon, said unit communicating with the interior (5) of the container and releasing a defined quantity of active ingredient when said float (3) is raised, and further comprising a release control unit (7, 8, 10) having a movable collecting chamber (7, 6*a*) positioned to collect said defined quantity of released active ingredient and an overflow syphon positioned in said chamber for transferring said defined quantity of active ingredient into the surrounding liquid.

2. The device of claim 1, wherein said collecting chamber surrounds said metering unit and has said syphon positioned in the bottom thereof.

3. A device according to claim 2, wherein the overflow syphon comprises an overflow pipe (8) which passes through the bottom (7*a* ) of the chamber (7, 6*a* ) and a beaker (10) which surrounds the pipe and is open at the bottom, the edge of the opening of the beaker being located at a distance from the bottom (7*a* ) of the collecting chamber (7, 6*a* ).

4. A device according to claim 2, wherein the release-control unit (7, 8, 10) is a float.

5. A device according to claim 1, wherein the metering unit comprises a pipe nozzle (2) which is substantially vertical in the use position and communicates with the interior of the stock container (5), and a metering chamber (9) which is located on the float (3), is open at the top and surrounds the pipe nozzle (2), and wherein the float (3) with the metering chamber (9) is guided vertically so that it can move up and down between two end positions, the lower end (2*a*) of the pipe nozzle (2) being located, when in the lower end position, essentially at the approximate height of the edge (9*b*) of the opening of the metering chamber (9) and, when in the upper end position, at the end (2*a*) of the pipe nozzle projecting further into the metering chamber (9).

6. A device according to claim 5, wherein the lower end (2*a*) of the pipe nozzle (2) rests on the chamber bottom (9*a*), when the float (3) is in the upper end position, and thus limits the upward movement of the float.

7. A device according to claim 5 or 6, wherein the float (3) has a guide rod (11) which is fixed to the bottom (9*a*) of the metering chamber (9) and extends through the pipe nozzle (2) and is guided therein.

8. A device according to claim 7, wherein the free end of the guide rod (11) contains stop elements (11*a*) which are elastically deformable radially inwards and which reach around the end of the pipe nozzle (2) on the container side and limit the downward movement of the float (3).

9. A device according to claim 1, wherein the metering unit (2, 9, 3) and the release-control unit (7, 8, 10) are located on a carrier (1), said carrier being a closing plug for the stock container.

10. A device according to claim 5, wherein the collecting chamber (7) coaxially encloses the metering chamber (9).

11. A device according to claim 1, wherein the float (3) has an annular air chamber (6, 7), which is open at the bottom, in order to generate buoyancy.

12. A device according to claim 11, wherein the collecting chamber (7) widens towards the top and the edge of its opening is fixed to the inner periphery of a coaxial float tube (6), the air chamber being formed by the tube (6) and the outer wall of the collecting chamber (7).

13. A device according to claim 12, wherein the float tube (6), the collecting chamber (7) or the overflow (8) of the latter are formed integrally.

14. A device according to claim 13, wherein the metering chamber (9), the guide rod (11) and the beaker (10) which is open at the bottom are formed integrally, the metering chamber (9) and the beaker (10) being arranged coaxially and having a common bottom (9*a*), and the unit consisting of these three parts (9, 10, 11) is coaxially fixed by means of a snap-in connection (12, 13) in the unit consisting of the collecting chamber (7), the overflow (8) and the tube (6).

15. A device according to claim 9 or 12, wherein the carrier (1) which carries the pipe nozzle (2) is formed as a cap which is open at the bottom, the external diameter of the float tube (6) is smaller than that of the cap (1) and , when the float (3) is in the upper end position, at least a part of the float tube (6) is located within the cap (1).

16. The device according to claim 2, wherein the overflow siphon comprises an overflow pipe (8) which passes through the bottom (7*a*) of the chamber (7,6*a*) and a beaker (10) which surrounds the pipe and is provided with passage orifices (10*a*), the orifices being located at a distance from the bottom of the collecting chamber.

17. The device according to claim 2, wherein the release control unit (7, 8, 10) is positioned in float (3).

* * * * *